US009109406B2

(12) United States Patent
Lammertink

(10) Patent No.: US 9,109,406 B2
(45) Date of Patent: Aug. 18, 2015

(54) METHOD FOR REMOVING A HYDROCARBON PRODUCTION PLATFORM FROM SEA

(75) Inventor: Marinus Christiaan Lammertink, Heemstede (NL)

(73) Assignee: HEEREMA MARINE CONTRACTORS NEDERLAND SE, Leiden (NL)

( * ) Notice: Subject to any disclaimer, the term of this patent is extended or adjusted under 35 U.S.C. 154(b) by 527 days.

(21) Appl. No.: 13/422,036

(22) Filed: Mar. 16, 2012

(65) Prior Publication Data

US 2012/0234549 A1 Sep. 20, 2012

Related U.S. Application Data

(60) Provisional application No. 61/453,228, filed on Mar. 16, 2011.

(30) Foreign Application Priority Data

Mar. 16, 2011 (NL) ..... 2006407

(51) Int. Cl.
*E21B 7/12* (2006.01)
*E21B 15/02* (2006.01)
(Continued)

(52) U.S. Cl.
CPC ..... *E21B 15/02* (2013.01); *E02B 17/0034* (2013.01); *E21B 19/002* (2013.01); *E02B 2017/0052* (2013.01)

(58) Field of Classification Search
CPC ..... E02B 17/00
USPC ..... 166/340, 352, 365; 114/264, 265; 405/195
See application file for complete search history.

(56) References Cited

U.S. PATENT DOCUMENTS 3,517,737 A * 6/1970 Petersen ..... 166/343
3,891,038 A * 6/1975 Delestrade et al. ..... 175/7
(Continued)

FOREIGN PATENT DOCUMENTS

EP 2070813 A2 6/2009
GB 2321290 A 7/1998
(Continued)

OTHER PUBLICATIONS

Olstad et al., "Case History of Innovative Plug and Abandonment Equipment and Processes for Enhanced Safety and Significant Cost Savings", (XP-002675859), SPE/IADC 140331, SPE/IADC Conference and Exhibition, 2011, pp. 1-7.
(Continued)

*Primary Examiner* — Matthew Buck
*Assistant Examiner* — Aaron Lembo
(74) *Attorney, Agent, or Firm* — Hoffmann & Baron, LLP

(57) ABSTRACT

A method for removing a hydrocarbon production platform at sea, the production platform being connected to a hydrocarbon well, and including a support structure and an upper part being supported by the support structure, where the method includes the steps of; temporarily closing the well, removing at least part of the upper part from the support structure, positioning a well abandonment module on the support structure, which well abandonment module is constructed and arranged to perform well abandonment operations, performing abandonment operations from the well abandonment module to abandon the well, removing the well abandonment module from the support structure after the well abandonment operations are completed.

9 Claims, 15 Drawing Sheets

(51) Int. Cl.
*E21B 19/00* (2006.01)
*E02B 17/00* (2006.01)

(56) References Cited

U.S. PATENT DOCUMENTS

| | | | | | |
|---|---|---|---|---|---|
| 4,125,164 | A | * | 11/1978 | Terry | 166/377 |
| 4,436,157 | A | * | 3/1984 | Brooks | 166/344 |
| 4,526,228 | A | * | 7/1985 | Wynn | 166/53 |
| 4,765,776 | A | * | 8/1988 | Howson | 405/169 |
| 5,322,118 | A | * | 6/1994 | Terrell | 166/55 |
| 5,388,930 | A | * | 2/1995 | McNease | 405/209 |
| 5,467,833 | A | | 11/1995 | Crain | |
| 5,704,427 | A | * | 1/1998 | Buck et al. | 166/338 |
| 6,601,649 | B2 | * | 8/2003 | Beato et al. | 166/352 |
| 7,380,609 | B2 | * | 6/2008 | Page et al. | 166/387 |
| 7,438,135 | B2 | * | 10/2008 | Page et al. | 166/387 |
| 8,387,704 | B2 | * | 3/2013 | Rodrigues | 166/352 |
| 2009/0321592 | A1 | | 12/2009 | Bryant, Jr. et al. | |
| 2010/0163244 | A1 | | 7/2010 | Desai et al. | |
| 2012/0273217 | A1 | * | 11/2012 | Hoffman et al. | 166/351 |
| 2013/0112479 | A1 | * | 5/2013 | O'Blenes | 175/40 |
| 2013/0180726 | A1 | * | 7/2013 | Ross et al. | 166/336 |
| 2014/0144708 | A1 | * | 5/2014 | Sherwood et al. | 175/66 |
| 2014/0162909 | A1 | * | 6/2014 | Ballard et al. | 507/116 |

FOREIGN PATENT DOCUMENTS

| | | | |
|---|---|---|---|
| WO | 97/13953 | A1 | 4/1997 |
| WO | 02/064940 | A1 | 8/2002 |
| WO | WO 2004/035985 | A1 | 4/2004 |

OTHER PUBLICATIONS

Search Report and Written Opinion for priority application NL 2006407.

David Harris et al, "New Offshore Rigless Intervention System", SPE/IADC Drilling Conference, No. SPE/IADC 104747, Feb. 20, 2007.

* cited by examiner

METHOD FOR REMOVING A HYDROCARBON PRODUCTION PLATFORM FROM SEA

CROSS-REFERENCE TO RELATED APPLICATIONS

This application claims the benefit of Netherlands Application No. 2006407, filed Mar. 16, 2011, and U.S. Provisional Application No. 61/453,228, filed Mar. 16, 2011, the contents of all of which are incorporated by reference herein.

FIELD OF THE INVENTION

The invention relates to a method for removing a hydrocarbon production platform from sea and a well abandonment module for use in said method.

BACKGROUND OF THE INVENTION

Hydrocarbons are generally retrieved from hydrocarbon wells that are located in the subsoil. When a hydrocarbon field is located at sea, one or more holes are drilled in the topsoil from a hydrocarbon production platform in order to create a passage to retrieve the hydrocarbons to the surface. When a hydrocarbon well is depleted, or production has become economically unattractive, operations are stopped and the drilling and/or production facilities are dismantled. For a hydrocarbon production platform, dismantling amongst others includes removing all equipment from the wellbore, closing the borehole and removing any subsea equipment and pipelines. It further includes removal of the production platform. The production platform in general is connected to the hydrocarbon well, and comprises a support structure and an upper part being supported by said support structure. In practice the upper part is also often referred to as the top side of the production platform.

The known method used for removing a hydrocarbon production platform from sea comprises the following subsequent steps which will be discussed in detail;

performing well abandonment operations to abandon the well, performing removal preparation operations on the production platform, removing the upper part from the support structure and removing the support structure.

The operations to abandon the well are often also referred to as "plugging and abandonment" of the well. During said operations, the borehole of the well is closed. As long as the well abandonment operations have not been completed, the well is considered to be "hot". The moment the abandonment operations have been completed the well is considered to be "cold".

In order to facilitate the abandonment operations, an assisting vessel is placed near the production platform for assistance during the abandonment operations. This may for instance be a jack up vessel. The assisting vessel provides the necessary equipment which is not available on the production platform. The assisting vessel furthermore may provide living quarters and a helicopter platform. The removal preparation operations on the production platform may include amongst others the checking of pipelines on the upper part to ensure there are no flammable substances left in them, checking existing or creating new lift points for removal of the upper part, securing or removing loose items, and preparatory work to facilitate the removal.

Once the removal preparation operations are completed, the upper part is removed from the support structure. This may for instance be performed by a lifting vessel, such as a crane vessel. The upper part may be transported to shore for further processing by the crane vessel, a transportation barge, a cargo vessel or the like.

After that, the support structure is removed. The support structure can include a lattice structure, also known as a jacket, or a different type of structure. Said removal of the support structure can be performed by the same or a different lifting vessel.

The well abandonment operations in general have a duration of several months, but can last up to several years. This depends on the number and type of hydrocarbon wells that needs to be abandoned, as well as other factors like the depth and distance of the well and the characteristics of the different soil formations that are crossed by the wellbore.

The removal preparation operations in general have a duration of several weeks up to several months, depending on the type of system to be dismantled.

The removal of the upper part from the support structure and the removal of the production platform in general takes about one or more weeks up to several months.

Thus the well abandonment operation in general is very time consuming. It is required that the assisting vessel is positioned near to the platform for the duration of said well abandonment operations. The costs for such an assisting vessel can be considerable, in the order of several hundreds of thousands of dollars per day, up to 500.000 dollar per day or even more.

In the known method, the actual removal of the production platform starts once the abandonment operations are completed (once the well is considered to be "cold"). In the technical field of hydrocarbon production platforms, there is a general assumption that for a safe removal of an hydrocarbon production platform it is required that the wells to which the production platform is connected are made "cold" before the actual removal of the production platform is started. An object of the invention is to provide an improved or at least an alternative method for removing a hydrocarbon production platform. The object is achieved by a method for removing a hydrocarbon production platform from sea, said production platform being connected to a hydrocarbon well, and comprising a support structure and an upper part being supported by said support structure, wherein the method comprises the steps of;

A. temporarily closing the well,

B. removing at least part of the upper part from the support structure,

C. positioning a well abandonment module on the support structure, which well abandonment module is constructed and arranged to perform well abandonment operations, D. performing abandonment operations from the well abandonment module to abandon the well, E. removing the well abandonment module from the support structure after the well abandonment operations are completed.

SUMMARY OF THE INVENTION

The method according the invention allows that the well abandonment operations are preformed from the well abandonment module positioned on the support structure of the production platform. This way it is not required that an expensive vessel for assisting the well abandonment operations is positioned near the production platform for the duration of said operations. This results in cost savings for the removal of the production platform.

The production platform may comprise a fluid connection comprising a riser and a wellbore.

Step D may comprise disconnecting the riser from the well.

Step D may comprise performing abandonment tests required to declare the well as being abandoned.

The production platform may comprise a well head and in step A the valves on the well head are closed.

Step A may comprise providing a temporary closure in the fluid connection.

Step A may comprise providing a temporary closure in the fluid connection at a location above the well.

The temporary closure may be located in the riser.

The temporary closure may be located in the well bore.

Step D may comprise providing at least two permanent fluid barriers in the borehole of the well.

The abandonment tests may comprise testing the permanent fluid barriers.

The abandonment operations may be performed without the assistance of an assisting vessel positioned near the platform.

The time required for step A may be at least 3 times smaller than the time required for step D.

The method may comprise placing the well abandonment module on the support structure at a location where the removed at least part of the upper part was located.

The method may comprise performing the steps A-E in subsequent order.

The method may comprise providing the well abandonment module comprising well abandonment equipment.

The method may comprise providing the well abandonment module comprising equipment which is required for well abandonment operations and not for hydrocarbon production.

The method may comprise providing the well abandonment module comprising drilling equipment.

The method may comprise providing the well abandonment module comprising living accommodations.

The method may comprise providing the well abandonment module comprising a landing platform for a helicopter.

The steps B and C may be performed by a first lifting vessel located near the production platform.

Step C may comprise transporting the well abandonment module to the production platform.

Step C may comprise lifting the well abandonment module on the support structure with the first lifting vessel.

Step B may comprise lifting the removed at least part of the upper part from the production platform with the first lifting vessel.

Step B may comprise transporting the removed at least part of the upper part away from the production platform.

Step E may be performed from a second lifting vessel located near the production platform.

Step E may comprise lifting the removed well abandonment module from the support structure with the second lifting vessel.

Step E may comprise transporting the removed well abandonment module away from the abandoned well.

Step B may comprise partly removing the upper part from the support structure and step E may comprise removing the remaining part of the upper part from the support structure.

Step E may comprise transporting the remaining part of the upper part away from the abandoned well.

Step B may comprise completely removing the upper part from the support structure.

Step E may comprise removing the support structure.

Step E may comprise transporting the removed support structure away from the abandoned well.

The method may comprise performing removal preparation operations on the production platform before step B.

The removal preparation operations may comprise cleaning of oil and/or gas pipes located on the production platform.

Step B may comprise disconnecting the at least part of the upper part from the support structure.

Step E may comprise disconnecting the remaining part of the upper part from the support structure.

The first lifting vessel may be equal to the second lifting vessel.

The steps B, C and E may be performed by the same vessel.

The steps B and C may be performed by a first vessel and step E may be performed by a different second vessel.

The method may comprise transporting the well abandonment module removed from the support structure to a further production platform to perform the steps A-E on the further production platform.

The method may comprise after step E adapting the well abandonment module such that the well abandonment module can be positioned on the further support structure.

The well abandonment module may comprise a hoisting device constructed and arranged for hoisting operations to and from the well, which hoisting device is a gantry crane which is moveable along a trajectory, and wherein step C may comprise positioning the well abandonment module on the support structure such that the gantry crane is moveable into a position above the well.

The well abandonment module may comprise a pipe reel comprising a length of pipe and step D may comprise moving an abandon tool from the well abandonment module to the well, or vice versa, via the pipe.

The length of the pipe may be at least 1000 m and step D may comprise moving the abandon tool with the pipe along a distance of at least 500 m. Step D may comprise moving the abandon tool with the pipe along a distance of about 1000 m.

The pipe may comprise an outer diameter of at least 0.15 m and step D may comprise moving the abandon tool with the pipe.

The well abandonment module may comprise an operation opening and the step C may comprise positioning the well abandonment module on the support structure such the operation opening is located above the well.

The production platform may be connected to multiple wells, the well abandonment module may be constructed and arranged to work on at least two wells at the same time and step D may comprise performing well abandonment operations from the well abandonment module on at least two of the wells at the same time to abandon said wells.

The invention further relates to a well abandonment module constructed and arranged to assist in hydrocarbon well abandonment operations and comprising a module frame constructed and arranged to in use be positioned on a support structure of a hydrocarbon production platform which is connected to a hydrocarbon well.

The well abandonment module may comprise well abandonment equipment.

The well abandonment module may comprise equipment which is required for well abandonment operations and not for hydrocarbon production.

The well abandonment module may comprise drilling equipment.

The well abandonment module may comprise living accommodations.

The well abandonment module may comprise a first module frame and a separate second module frame.

The first module frame may comprise well abandonment equipment and the second module frame may comprise living accommodations.

The first module frame may comprise drilling equipment.

The well abandonment module may comprise a landing platform for a helicopter.

The second module frame may comprise the landing platform.

The well abandonment module may be constructed and arranged to be removed from the support frame and be positioned on a further support frame of a further production platform.

The well abandonment module may comprise a hoisting device constructed and arranged for hoisting operations to and from the well.

The hoisting device may be a gantry crane which is moveable along a trajectory.

The well abandonment module may be constructed and arranged such that gantry crane in use is moveable in a position above the well.

The well abandonment module may comprise a pipe reel comprising a length of pipe.

The length of the pipe may be at least 1000 m.

The pipe may have an outer diameter of at least 0.15 m.

The well abandonment module may comprise an operation opening.

The hoisting device may extend above the operation opening.

The well abandonment module may comprise a work floor extending above the operation opening.

The well abandonment module may be constructed and arranged to work on at least two wells at the same time.

The invention further relates to a well abandonment module constructed and arranged for use in the method according to any of the claims.

The invention further relates to the use of the well abandonment module.

BRIEF DESCRIPTION OF THE DRAWINGS

Embodiments of the method and well abandonment module according the invention will be described by way of example only, with reference to the accompanying schematic drawings in which corresponding reference symbols indicate corresponding parts, and in which.

DETAILED DESCRIPTION OF THE INVENTION

Figure 1:
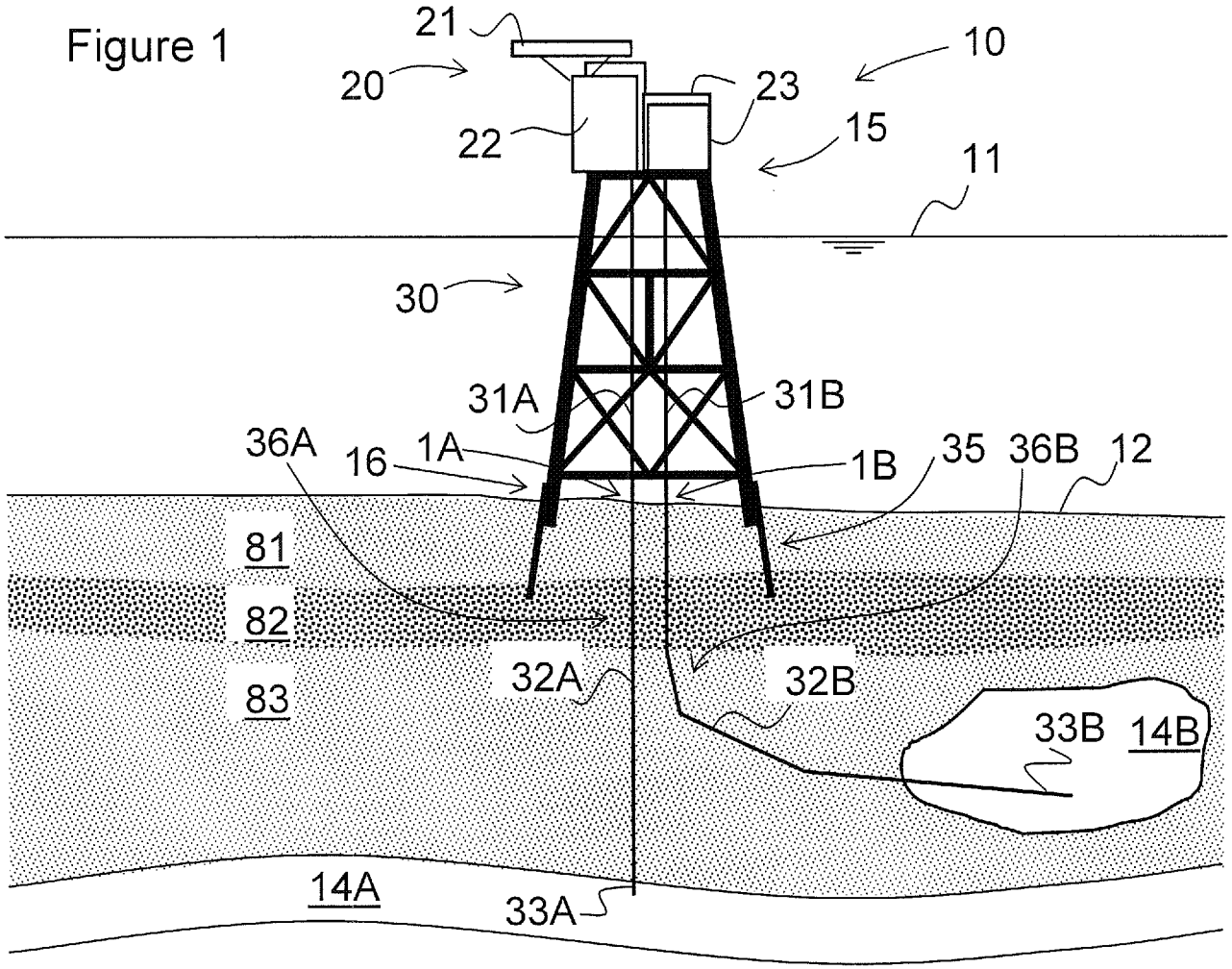
FIG. 1 schematically shows a production platform during its production stage, FIG. 2 schematically shows the known method for removing a hydrocarbon production platform at sea, FIGS. 3-6 schematically show an embodiment of the method for removing a hydrocarbon production platform at sea production platform according the invention, FIG. 7 schematically shows a first view in perspective of a first embodiment of the well abandonment module according to the invention, FIG. 8 schematically shows a second view in perspective of the well abandonment module of FIG. 7, FIGS. 9 and 10 schematically show a second embodiment of the well abandonment module according the invention, FIGS. 11-13 schematically show a third embodiment of the well abandonment module according the invention, FIG. 14 schematically shows a fourth embodiment of the well abandonment module according the invention, and FIG. 15 schematically shows examples for temporary closing the well and an abandoned well.

FIG. 1 shows a hydrocarbon production platform 10 at sea in its operational stage. The production platform 10 comprises a support structure 30. The support structure 30 comprises a lattice structure known as a jacket, but other structures are possible as well. An upper part 20 is located on top of the support structure 30. The upper part 20 comprise production equipment 23 required for obtaining and/or processing hydrocarbons, living quarters 22, and a helicopter landing platform 21. Drilling equipment can also be provided on the upper part 20.

The upper end 15 of the support structure 30 is located at a certain distance above sea level 11 to protect the upper part 20 positioned on top of the upper end 15 from waves. The lower end 16 is connected to the sea bed 12 via a foundation structure 35.

Hydrocarbons are harvested from reservoirs 14 located in or under soil layer 81-83. To this end, a hole is drilled with a drill string 36 from the upper part 20 into the soil layers 81-83 until a reservoir 14 is reached. Such a drilled hole is often referred to as a hydrocarbon well 1. A fluid connection is created between the reservoir 14 and the upper part 20. The fluid connection comprises a riser 31 which spans between the sea bed 12 and the upper part 20, and a wellbore 32, which is in general lined with a string of casings that crosses the various soil layers 81-83 until the end 33 of the wellbore 32 enters the reservoir 14. The end 33 of the wellbore 32 contains openings to allow the hydrocarbon fluids of the reservoir 14 to enter the wellbore 32. The production platform 10 is connected to a first well 1A and a second well 1B. Equipment to control the flow of the wells 1 may be located at the platform 10 or on the seabed 12.

Figure 2:
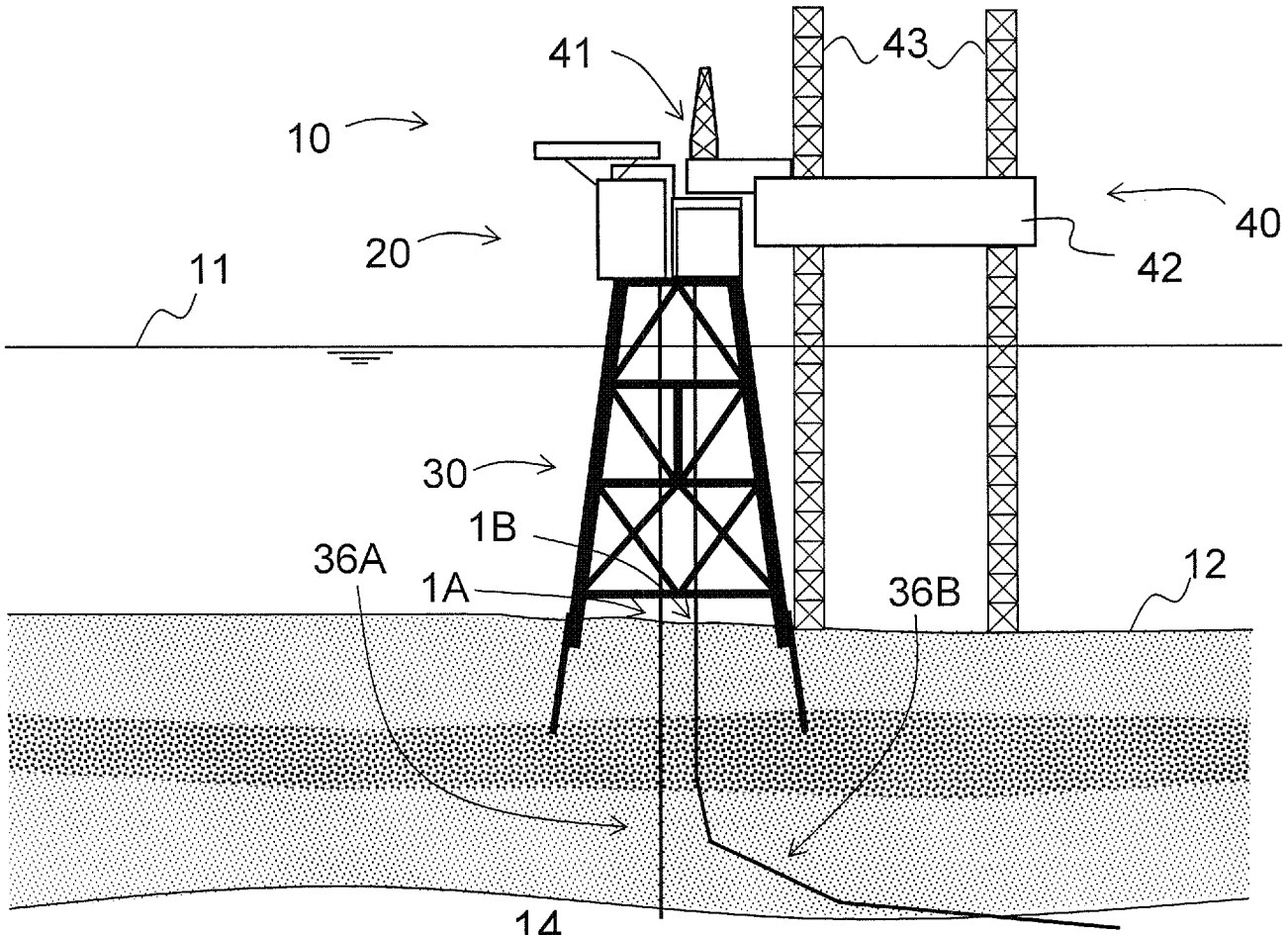

FIG. 2 shows the known method for removing a hydrocarbon production platform 10 at sea. An assisting vessel, more specifically a jack up vessel 40, is positioned alongside the production platform 10 to assist during the abandonment operations. The jack up vessel 40 comprises a hull 42 which can float on water. The hull 42 can sail or be towed across the sea. At the desired location, legs 43 are lowered onto the seabed 12 and the hull 42 can be raised above the waterline 11. In said situation, the hull 42 provides a stable working platform from which the abandonment operations can be performed. The jack up vessel 40 may contain an extendable cantilever 41 which can be maneuvered over the upper part 20 of the production platform 10 in order to reach a specific location where operations are to be performed. Various kinds of equipment, for instance drilling equipment or a multi purpose tower can be provided by the jack up vessel 40 if not available on the production platform. During well abandonment operations, the jack up vessel 40 can furthermore provide additional living accommodation and crane capacity if required.

Figure 3:
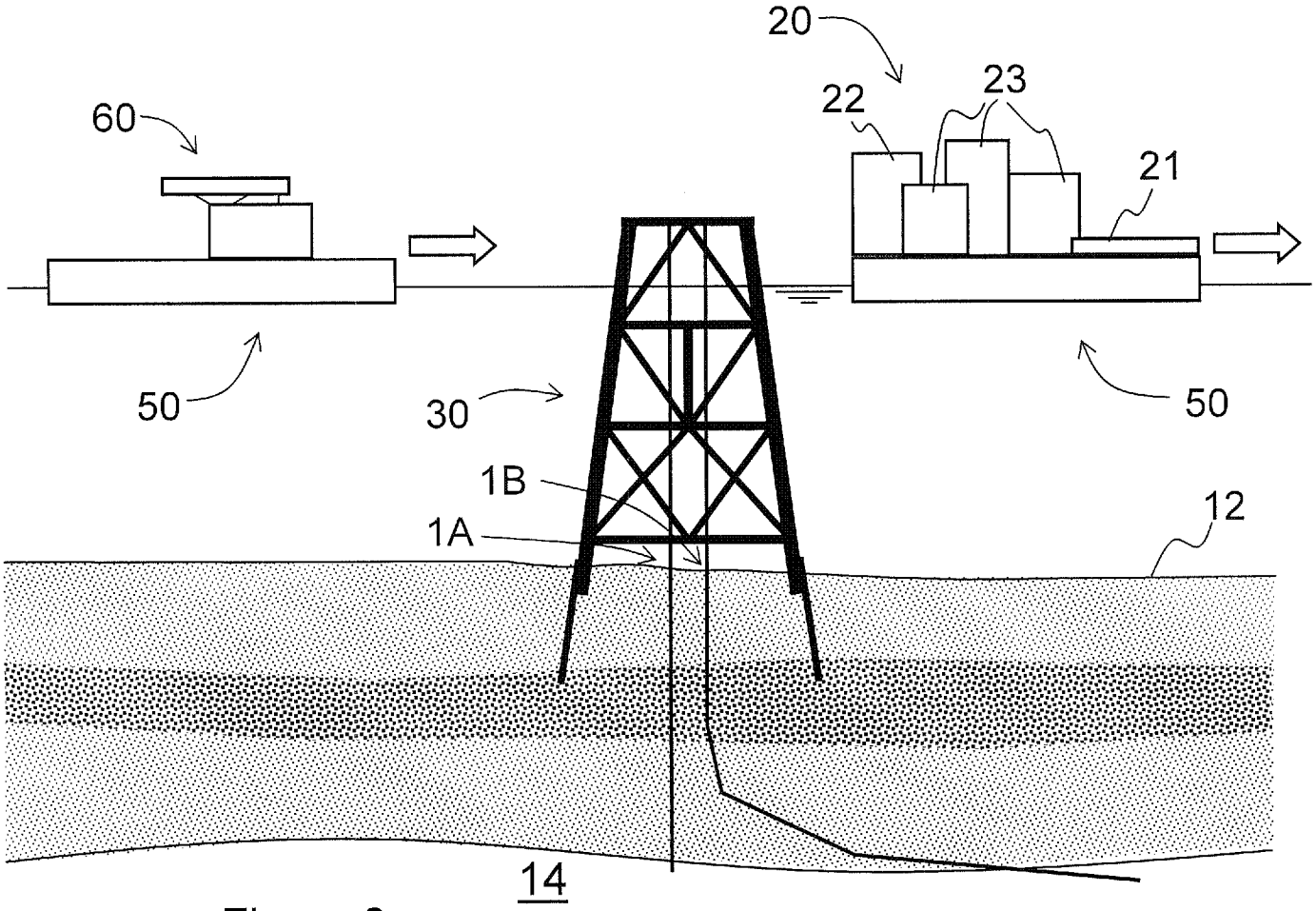
Figure 4:
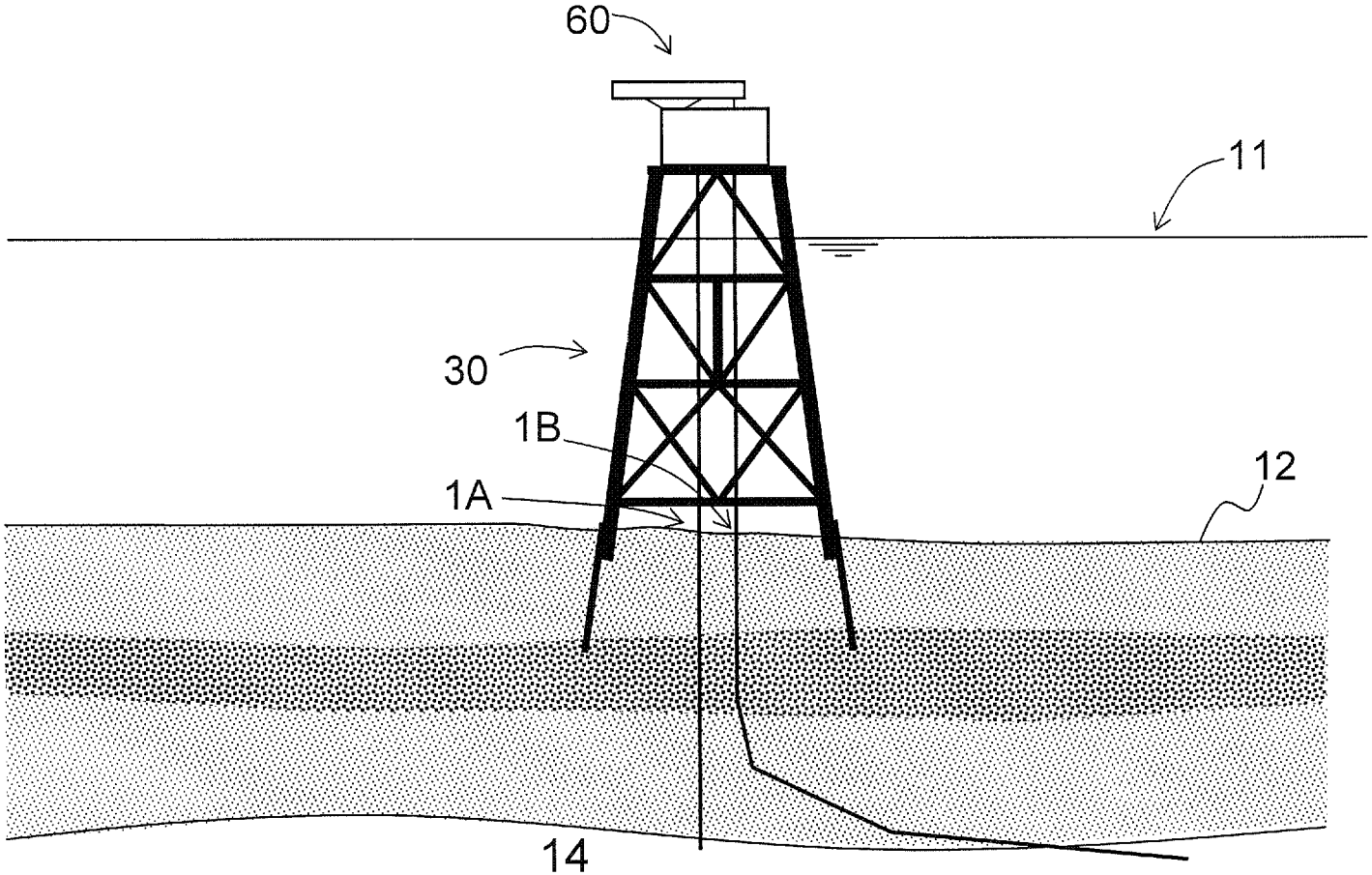

The FIGS. 3-6 show an embodiment of a method for removing a hydrocarbon production platform at sea according the invention. In FIG. 3 the upper part 20 is removed from the support structure 30. The removal can be performed by lifting the upper part 20 from the support structure 30 for instance by a lifting vessel (not shown), such as a crane vessel, onto a transportation vessel 50. The landing platform 21, living quarters 22 and production equipment 23 may be removed separately from the support structure 30 and positioned onto the transportation vessel 50. Other removal methods are feasible as well. It is also possible that only a part of the upper part 20 is removed, for instance that the production equipment 23 is removed and that the living quarters 22 and landing platform 21 remain on the support structure 30. Other combination are of course also possible.

Before lifting the upper part 20, removal preparation operations are undertaken to perform the removal operation safely. This includes for instance the cleaning of all piping on the upper part 20, removal of loose items, and construction of suitable lifting points. Before the (partly) removal of the upper part 20 takes place, the hydrocarbon wells 1 to which the production platform 10 is connected is temporarily closed. This can be done by closing the valves on the well head or any other valve or valves which will close the fluid connection. Additional safety precautions may be required before removal of the upper part 20 and/or placement of a well abandonment module 60 can commence. This may consist of erecting a temporary barrier to prevent the wellhead from impact during the removal and/or positioning operations. The additional measures for the safety precautions required may depend on the location of the wellheads relative to the upper part. The additional measures may consist of installation of guides and bumpers around the wellhead area up to erecting a dedicated construction sealing the wellhead area from its surroundings. Also partial removal of the upper part 20 may be an option, wherein the remaining part of the upper part 20 located on the support structure 30 can serve as protection structure. The additional measures may be required because the abandonment operations of the wells 1 has yet to take place. The wells 1 are therefore still considered to be "hot". The time period required for performing the operations for temporarily closing the well 1 is relatively short when compared to the well abandonment operations. The time period required for performing the operations for temporarily closing a well 1 and possible additional safety measures will strongly depend on the situation, but are more in the order of days or weeks instead of months to years.

In the known method, the preparations for the removal of the upper part 20 takes place after the abandonment operations have been completed (after the well is considered to be "cold"). The well abandonment operations take a long period to complete, up to several years. When the production operations on a production platform 10 have recently been stopped, the production platform 10 normally is in a reasonably good condition. Therefore, the production platform 10 is in the known method generally still in reasonably good condition at the start of the abandonment operations. During the long period of the abandonment operations the maintenance performed on the production platform 10 is generally at a very low level, or sometimes even completely stopped. Due to this, the general condition of the production platform 10 will rapidly deteriorate during the well abandonment conditions. Therefore, parts of the production platform 10 may become unsafe due to deterioration. This means that after the well abandonment operations are completed, the production platform 10 has to be checked to determine whether its condition allows safe removal of the upper part 20 and the support structure 30. In many cases maintenance operations have to take place to improve the condition of the production platform 10 to ensure a safe removal. This leads to additional costs for the removal operations in the known method.

After the (partly) removal of the upper part 20 in the method according the invention, a well abandonment module 60 can be transported to the site by a transportation vessel 50 and positioned onto the support structure 30. This can for instance be done by a lifting vessel. This results in the situation shown in FIG. 4, wherein the abandonment module 60 is positioned on the support structure 30 at the location where the removed upper part 20 was positioned. The method according the invention eliminates the costs for an assisting vessel, such as the jack-up vessel 40 of FIG. 2, as used in the known method. In the method according the invention the abandonment operations are performed from the abandonment module 60 located on the support structure 30. After the well abandonment operations are completed, the abandonment module 60 can be removed from the support structure 30 and reused for the removal of further production platforms. The abandonment module 60 can be upgraded where required to remain in conformance with the latest safety standards and regulatory requirements.

In the method according the invention, the (partly) removal of the upper part 20 from the support structure 30 is performed while the production platform 10 is in a relatively good condition. This because said removal takes place before the abandonment operations which in general take a long period, up to several years, leading to deterioration of the production platform 10.

Furthermore, in the known method most of the times a jack up vessel 40 is used as an assisting vessel because a jack up vessel provides a stable working platform. This often gives a problem when the production platform 10 to be removed is located in deeper waters. Jack up vessels can only accommodate platforms up to a certain depth, which is related to the length of their jacket legs 43. The method according the invention provides a stable working platform (the abandonment module 60 positioned on the support structure 30) at any water depth.

Figure 5:
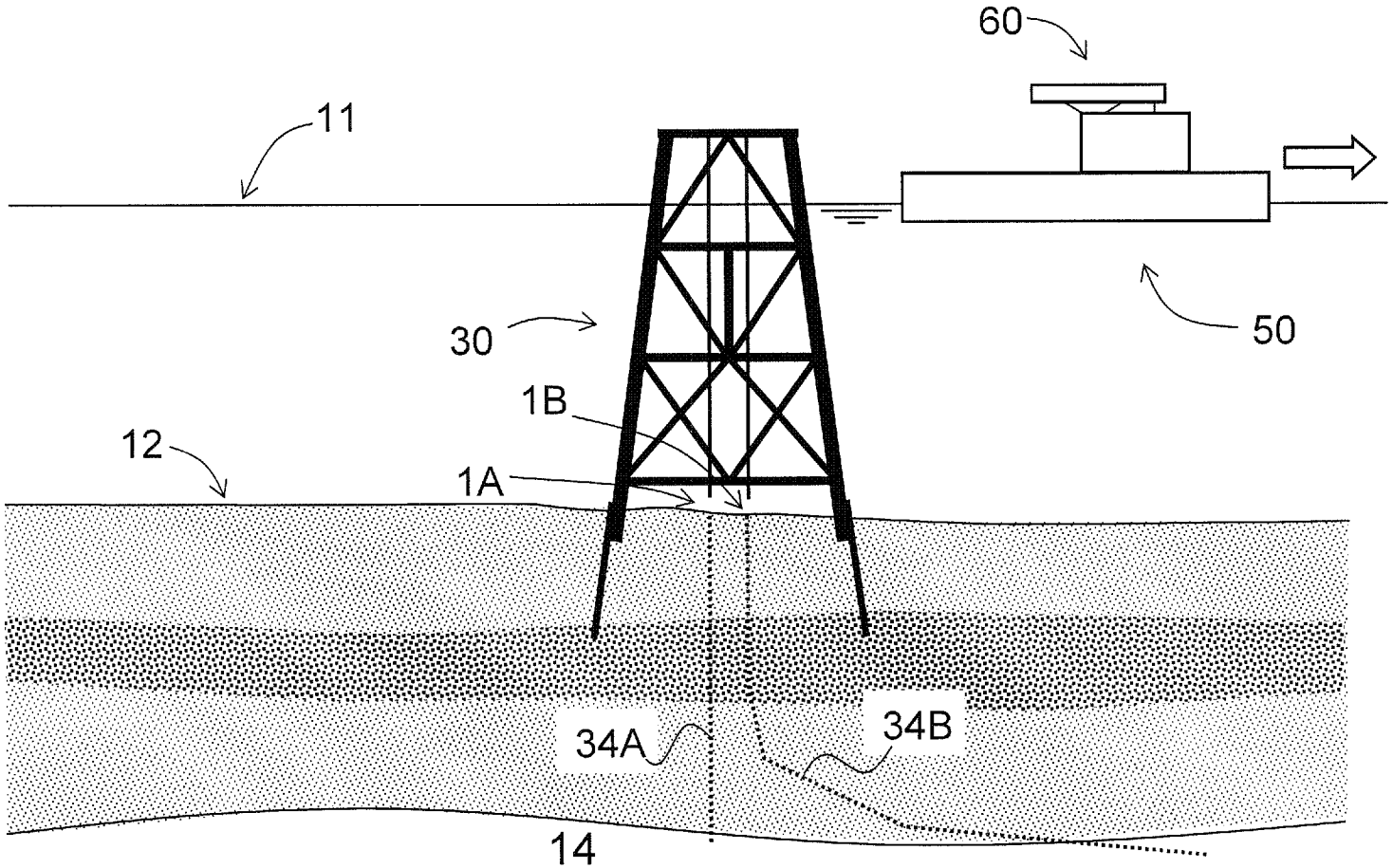

After completion of the well abandonment operations the wells 1 are considered to be "cold". The boreholes 34 of the wells 1 are closed. The risers 31 are disconnected from the wells 1. This is shown in FIG. 5. The abandonment module 60 is subsequently lifted of the support structure 30, for example by a lifting vessel, and transported to another location, for instance by a transportation vessel 50. Other options for removing and transporting the abandonment module 60 are feasible as well. The well abandonment module 60 may be reused for the removal of other production platforms.

Figure 6:
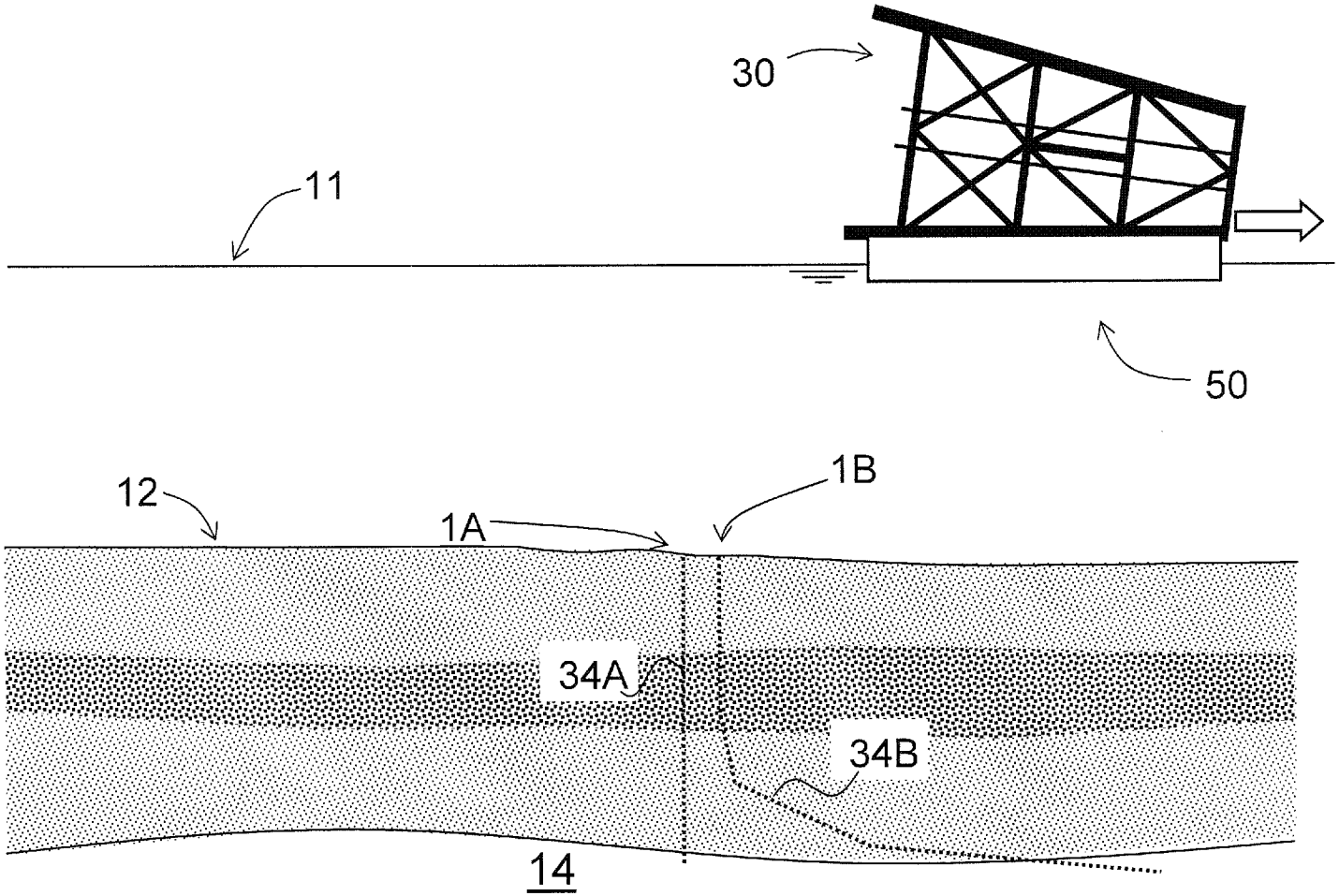

FIG. 6 shows the removal of the support structure 30 from the abandoned wells 1 by a transportation vessel 50. The support structure may be lifted on the transportation vessel 50 by a lifting vessel. Again, other options to remove the support structure are possible.

Figure 7:
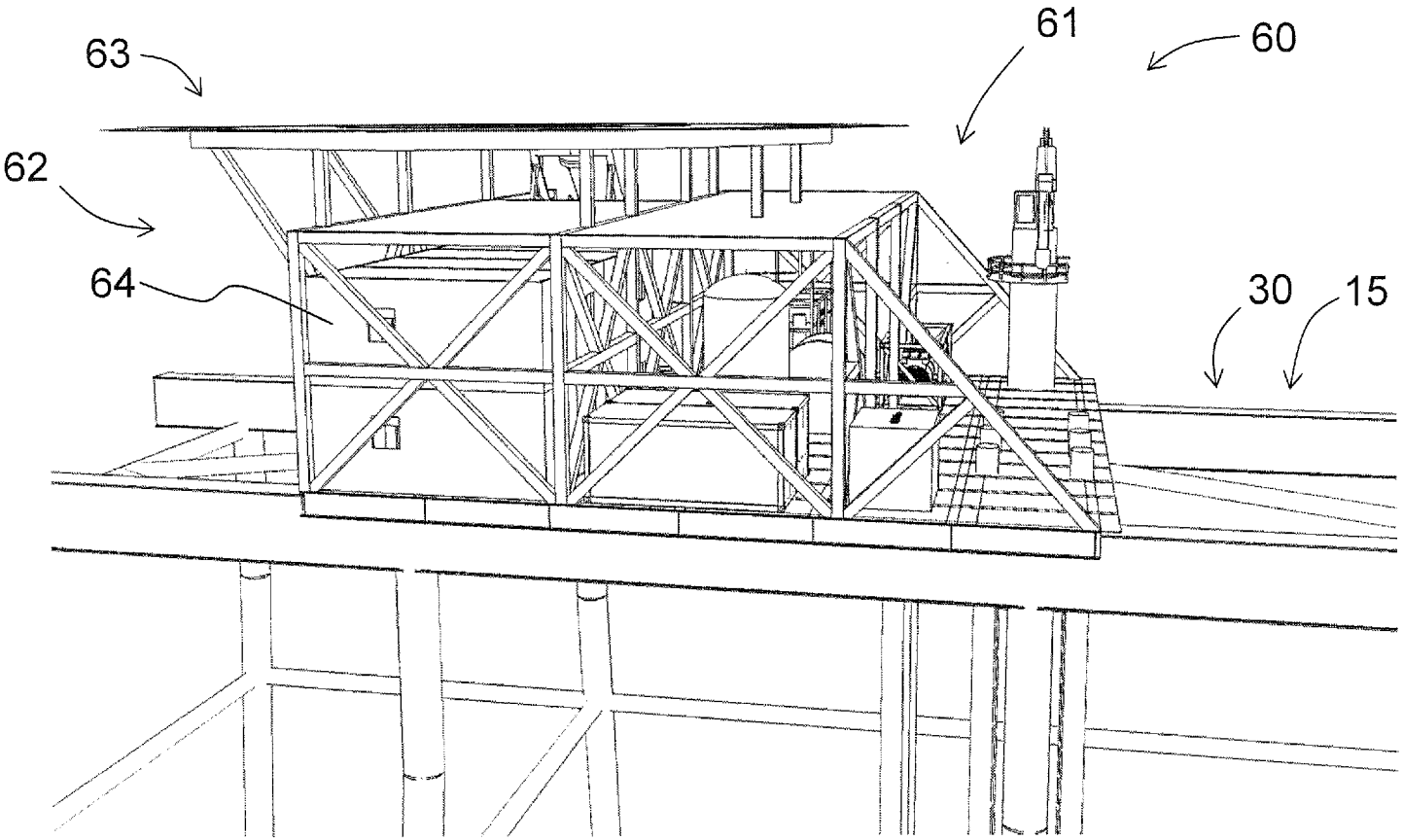
Figure 8:
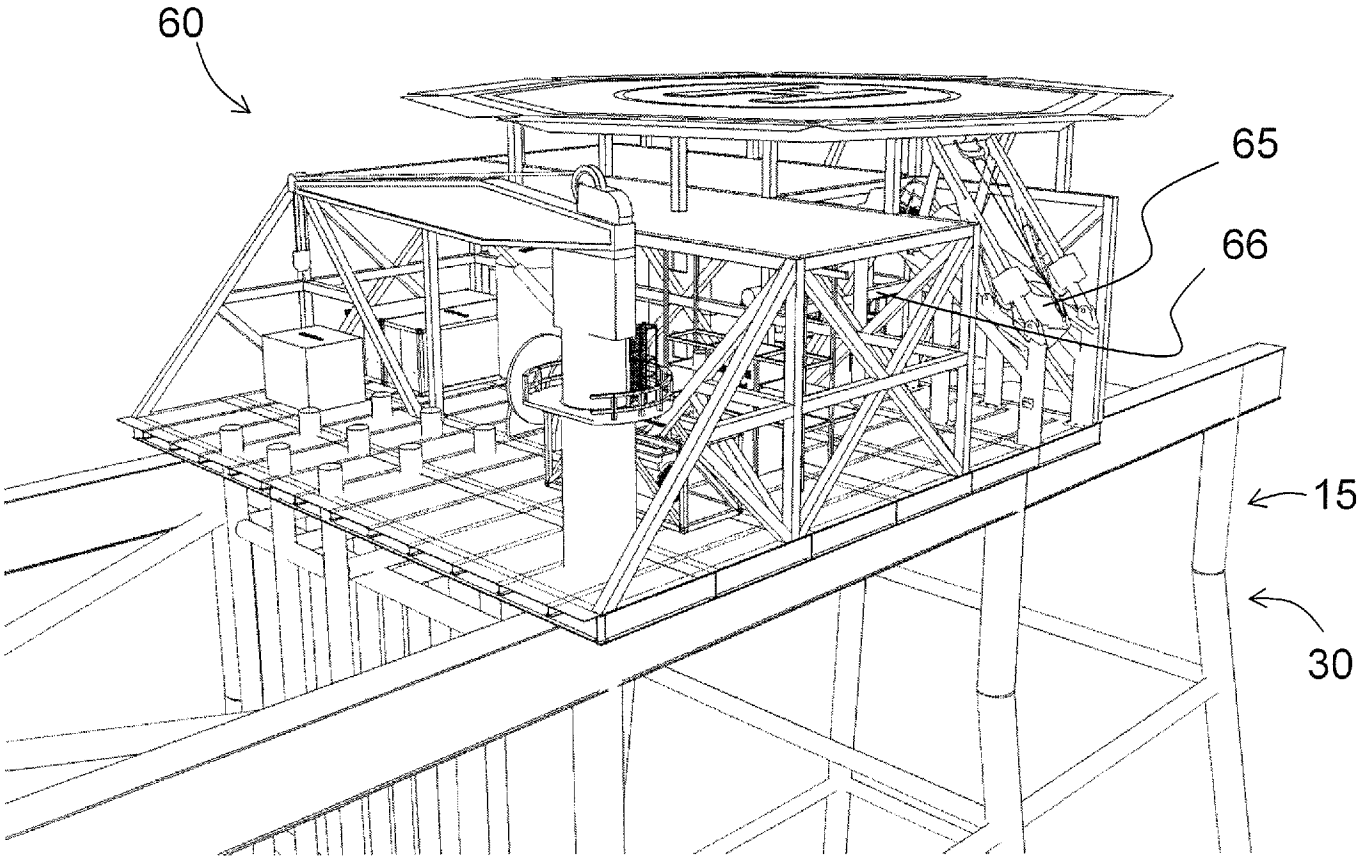

The FIGS. 7 and 8 show a first embodiment of a well abandonment module 60 according the invention. Said abandonment module 60 may be used in the method shown in the FIG. 3-6. The FIGS. 7 and 8 show the same abandonment module 60, but from a different angle. The well abandonment module 60 comprises well abandonment equipment 61 and living accommodations 62.

The well abandonment equipment module 61 comprises the equipment required for well abandonment operations. This may for instance include drilling equipment for conductor and casing recovery which may for instance consist of a cutting tool, a single or double drilling unit, hydraulic power units, lifting adaptors and jacking or torsion-based cut verification tools. Further equipment that needs to be provided may include equipment like material storage containers or silos, cement pumps, displacement tanks and cement blender, one or more cranes, and power supply.

The living accommodations 62 comprise the elements required for the crew to live on the well abandonment module 60, like living quarters 64, and power supply 66. Safety equipment is also provided, for instance via a life boat 65. The well abandonment module 60 comprises furthermore a helicopter platform 63. When required, other equipment or accommodation elements can be provided on the well abandonment module 60.

Figure 9:
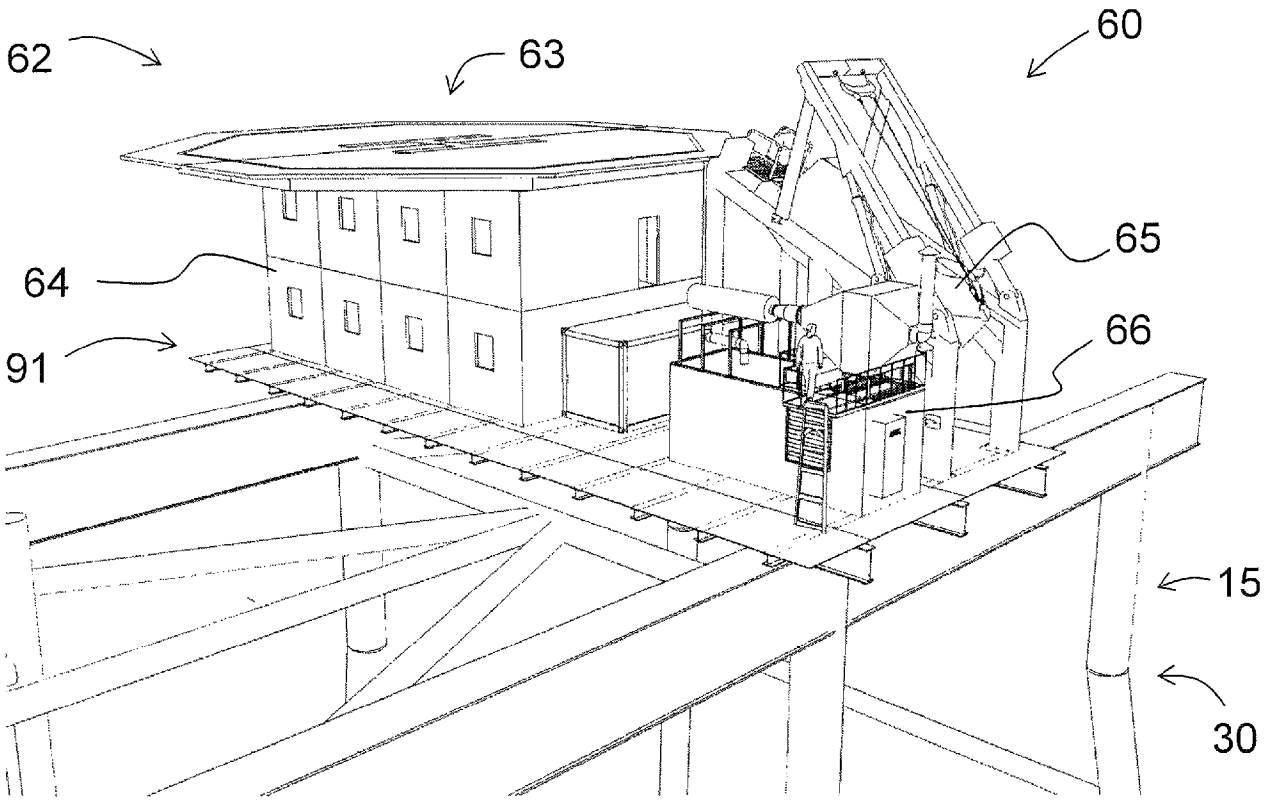
Figure 10:
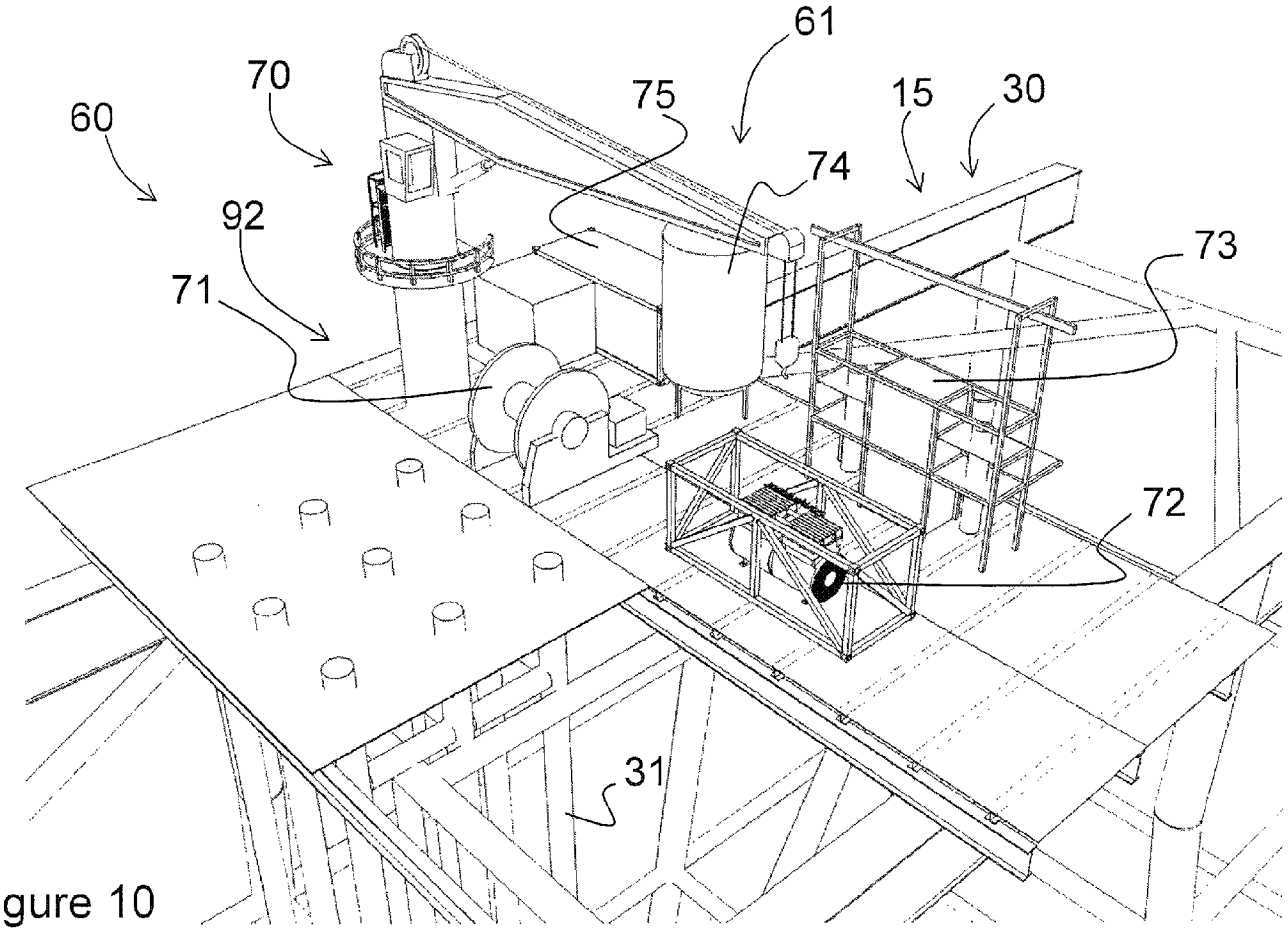

FIGS. 9 and 10 show a second embodiment of the well abandonment module 60 according the invention. The well abandonment module 60 comprises a first module frame 91 and a separate second module frame 92. The living accommodations 62 are located on the first module frame 91 and the abandonment equipment 61 are located on the second module frame 92. In FIG. 9 the living accommodations 62 are positioned on the support structure 30. In FIG. 10 the abandonment equipment 61 are positioned on the support structure 30. Storage and processing equipment 73 for the cement or other material used to plug the well are provided. Furthermore, a crane 70, winches 71 for lowering and raising tools or equipment into the wellbore, a compressor 72, power unit 75, storage means for plugging materials or water 74 are provided. Drilling or cutting equipment can be supplied as required as well.

The separate module frames 91, 92 provide additional flexibility in placement of the well abandonment module 60 on the support structure 30. Furthermore, additional safety may be provided by placing first module frame 91 with the living accommodations 62 on the support structure 30 at a distance from the second module frame with the abandonment equipment 61. The two module frame 91, 92 can be separately lifted onto the support structure 30 and can be interconnected by a gangway or other suitable connection that allows passage of personnel between them.

Figure 11:
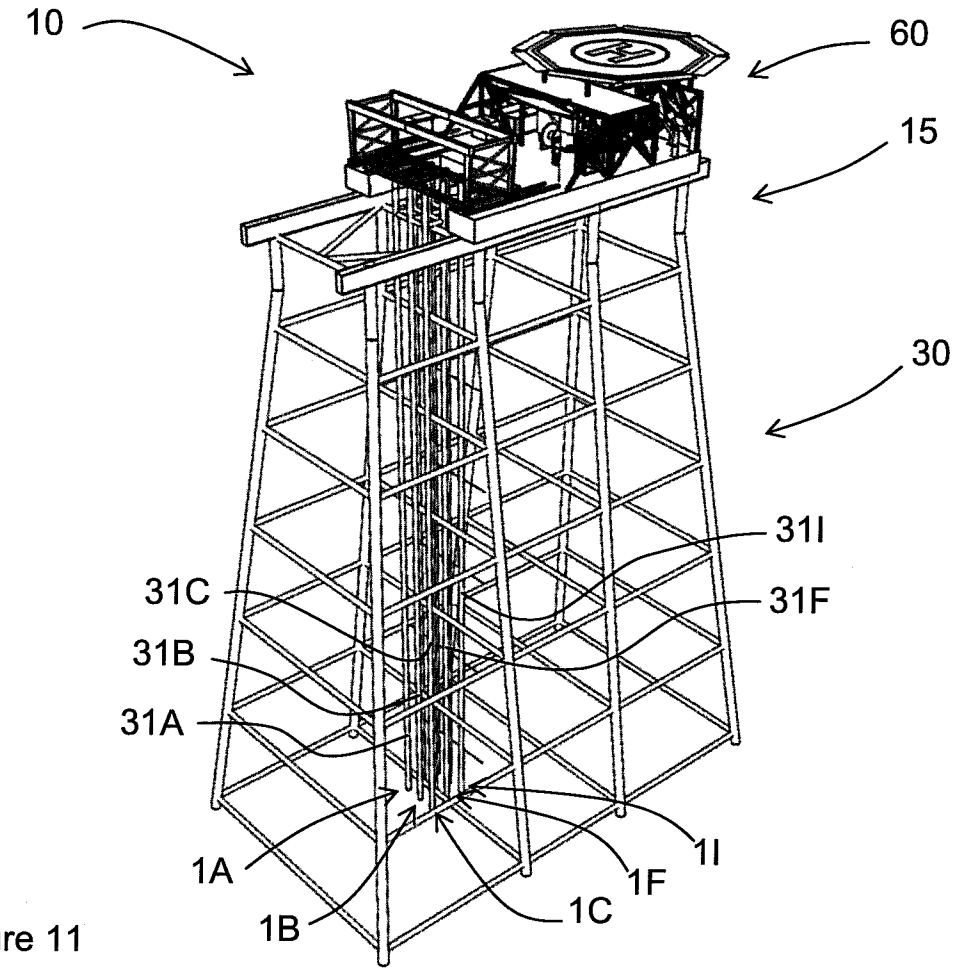
Figure 12:
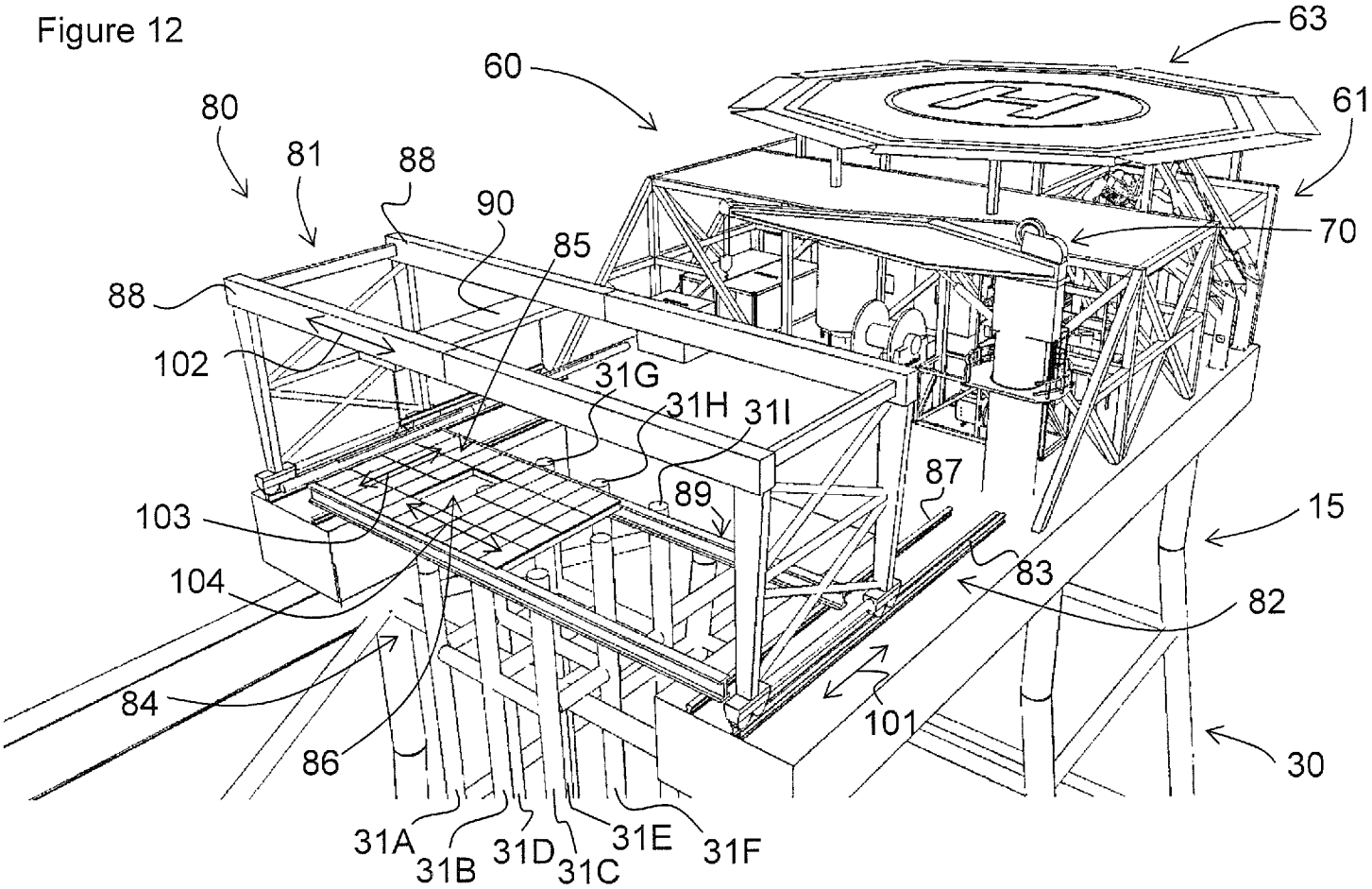
Figure 13:
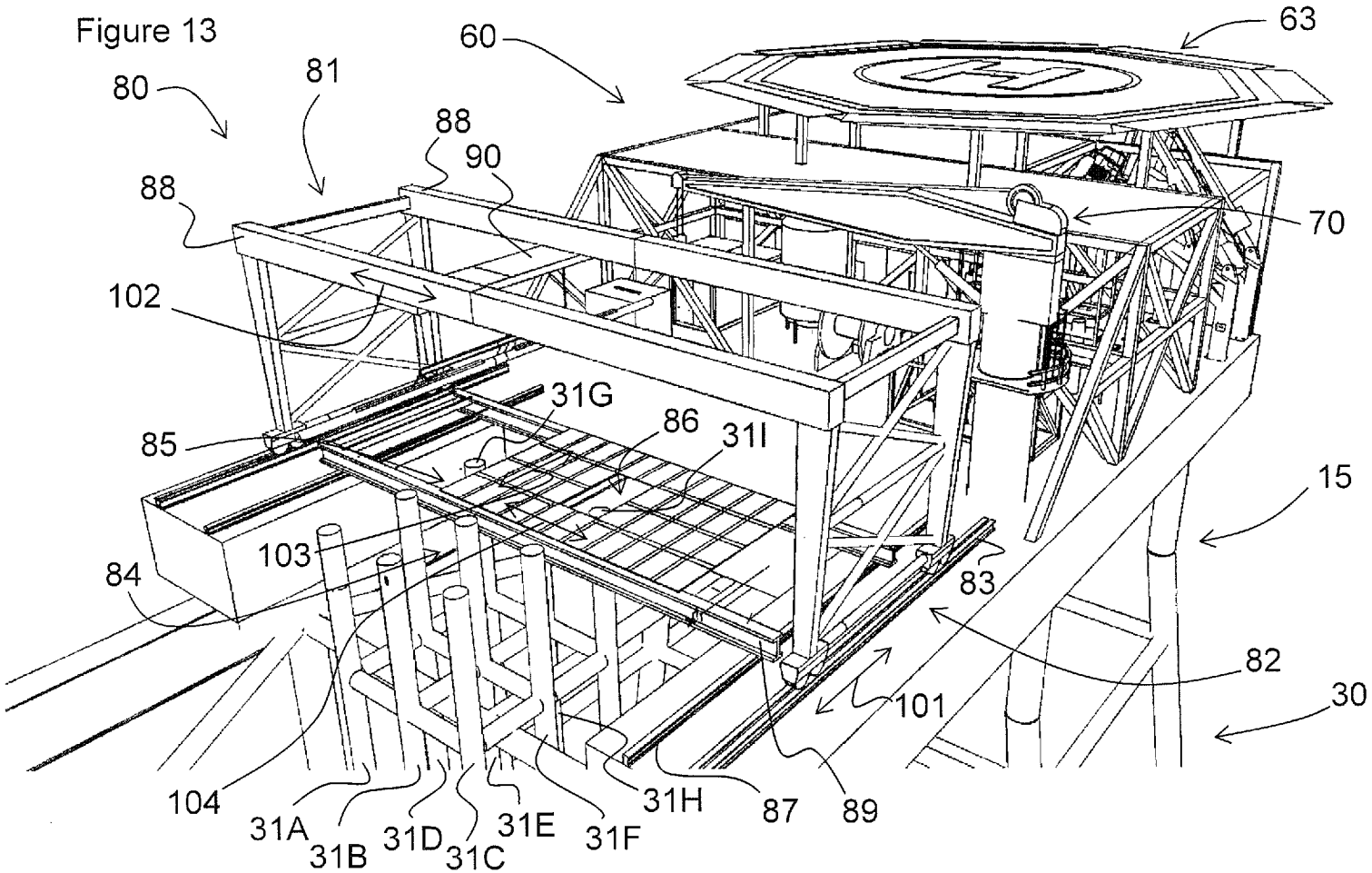

The FIGS. 11-13 show a third embodiment of the well abandonment module 60 according the invention. The production platform 10 is connected to nine wells 1A-I. Nine risers 31A-I extend from the wells 1A-I to the upper part 15 of the support structure 30.

A hoisting device 80 is provided on the well abandonment module 60. The hoisting device 80 comprises a gantry crane 81 which is moveable along a trajectory 82. The trajectory 82 is formed by two crane rails 83 along which the gantry crane 81 is moveable in a first direction 101. The gantry crane 81 comprises two gantry beams 88 which extend between the crane rails 83. In another embodiment, the gantry crane 81 may comprise a different number of gantry beams 88, such as only one gantry beam 88. A suspension member 90 is moveably connected to the gantry beams 88 such that the suspension member 90 can move in a second gantry direction 102. The gantry crane 81 and the suspension member 90 are constructed and arranged such that abandonment equipment can be connected to the suspension member 90 and positioned above the well 1A-I on which the abandonment operations are performed. The first and second gantry directions 101, 102 extend substantially perpendicular to each other.

The well abandonment module 60 comprises an operation opening 84. The well abandonment module 60 is positioned such on the support structure 30 that the operation opening 84 provides an access to the wells 1A-I and the risers 31A-I. The gantry beams 88 extend above the operation opening 84. The gantry crane 81 and the suspension member 90 are moveable such that the suspension member 90 can be positioned above each of the wells 1A-I and the risers 31A-I. The gantry crane 81 may be provided with multiple suspension members 90. This way, the gantry crane 81 can be used to work on multiple wells 1A-I at the same time.

The well abandonment module 60 comprises a moveable work floor 85 which can be positioned above the operation opening 84. The work floor 85 is moveable along floor rails 87 in a first floor direction 103. The work floor 85 is moveably connected to the floor rails 87 by two floor beams 89. The floor beams 89 are movable along the floor rails 87 in a second floor direction 104. The first and second floor direction 103, 104 extend substantially perpendicular. The work floor 85 comprises a work opening 86 which provides access to a specific part of the operation opening 84. The work floor 85 is movable such that the work floor 85 can be positioned above each of the wells 1A-I and the risers 31A-I. In use the work floor 85 can be positioned such that the abandonment equipment can reach the well 1A-I on which the abandonment operations are performed via the work opening 86 and the personnel can stand on the work floor 85 to control the abandonment equipment. The work floor 85 may be provided with multiple work openings 86. This allows that operations are performed at multiple wells 1A-I at the same time.

In a different embodiment, the work floor 85 extends over substantially the whole operation opening 84 and comprises multiple removable floor panels. By selectively placing and/or removing one or more floor panels, a work floor opening can be created at different locations on the work floor. Also multiple work floor openings can be created this way. In this embodiment of the work floor, it is not required that the work floor itself is movably connected to the well abandonment module.

Figure 14:
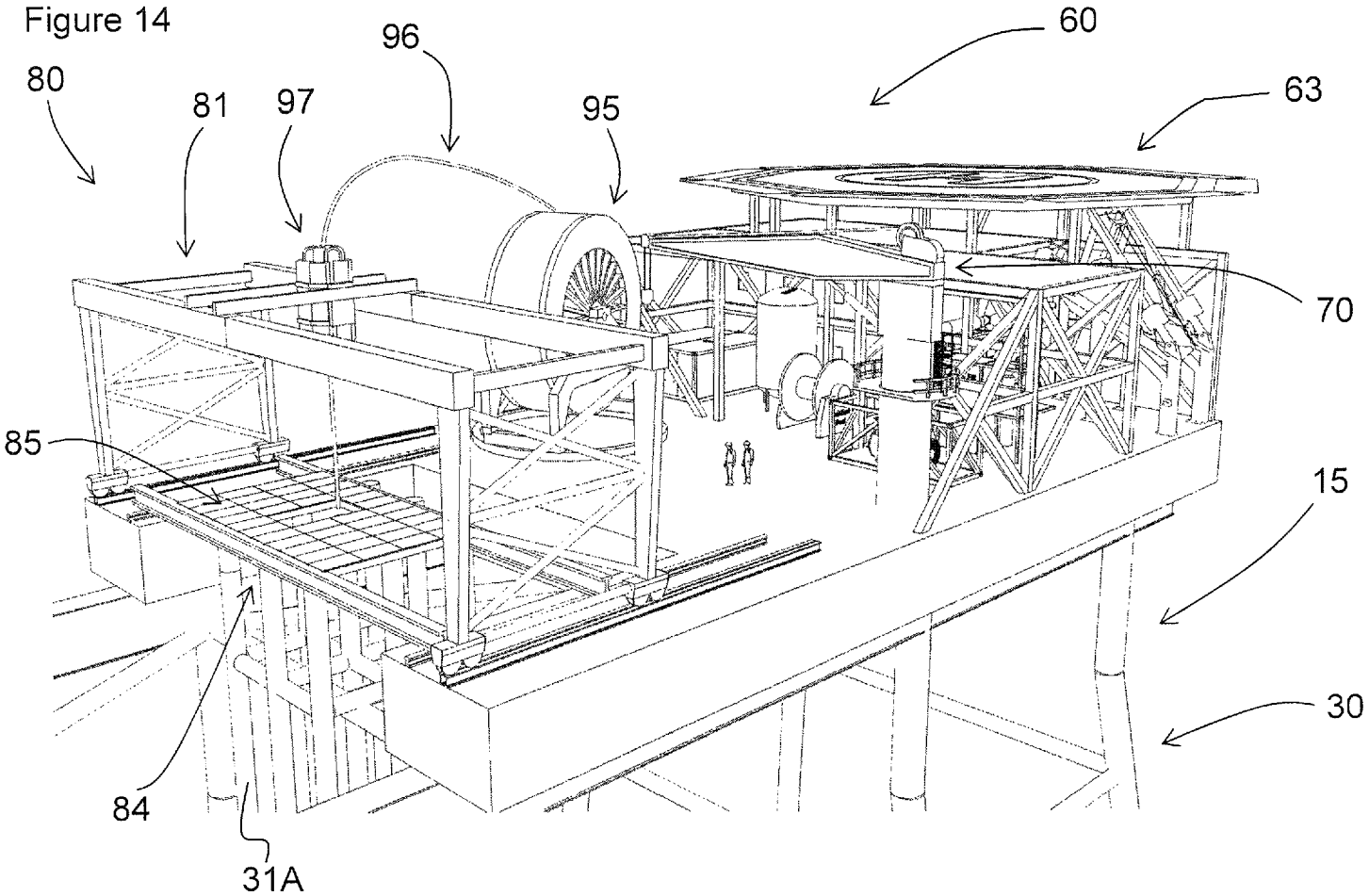

FIG. 14 shows a fourth embodiment of the well abandonment module according the invention. The well abandonment module 60 comprises a pipe reel 95 comprising a length of pipe 96. In practice such a reel is also referred to as a coiled tubing reel. The length of the pipe 69 is at least 1000 meter. The outer diameter of the pipe 96 is at least 0.15 meter. The outer diameter of the pipe 96 may be between 0.15 and 0.35 meter. A pipe driver 97 is provided to move the pipe 96 from the well abandonment module 60 to the well 1A-I, and vice versa. During the abandonment operations, abandon tools can be moved by the pipe 96 from the well abandonment module 60 to the well 1A-I, or vice versa. The abandon tools can be moved with the pipe 96 along a distance of around 500 meters or more.

The well abandonment module 60 is constructed and arranged to support one or more large reels 95. The reels 95 are installed and removed together with the module 60 itself. A reel with a diameter between 10-12 meters can this way be provided on the well abandonment module 60. This is considerably larger than coiled tubing reels used in the art, which have diameters in the order of 3 to 4 meters. The large reel 95 allows the use of pipe 96 with a larger outer diameter. This allows the use of larger and heavier tools. Even drill string may be reeled on such a large reel 95, making operations requiring drills more time effective.

Figure 15:
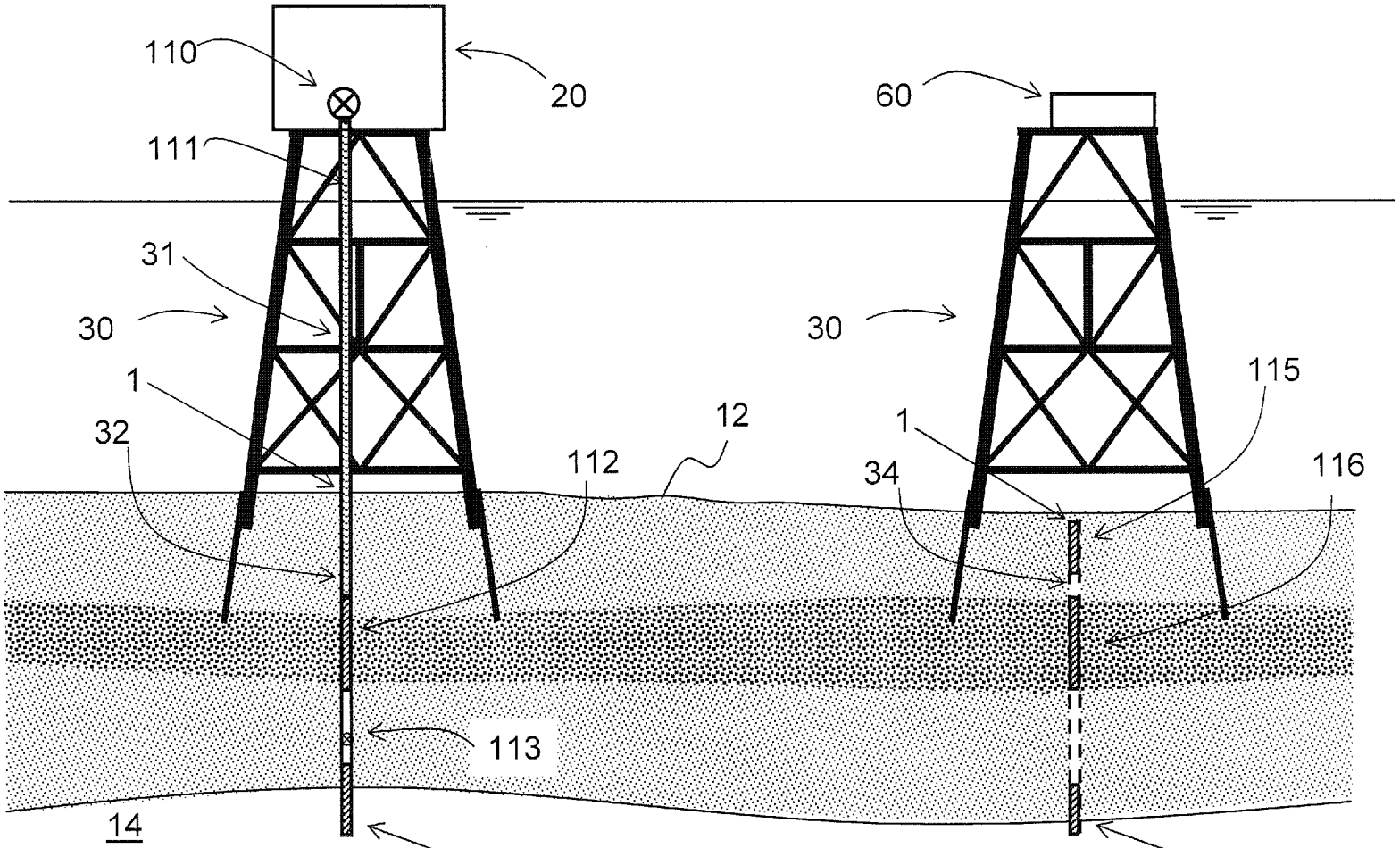

At the left side of FIG. 15, examples are shown of how the well can be temporary closed by providing different kinds of temporary closures. As indicated, the valves of well head 110 can be closed, a column of killing mud 111 can be provided in the riser 31 and/or wellbore 32, a temporary secondary cement plug 112 can be provided in the wellbore 32, a downhole safety valve 113 can be closed, or a (temporary) primary cement plug 114 can be provided in the wellbore 32. It is also possible that for temporary closing the well 1 a combination of two or more of such temporary closures are provided. When the well 1 is temporary closed, there is in practice still the option to re-enter the well 1.

At the right side of the FIG. 15, an abandoned well 1 is shown. The borehole 34 of the well 1 is provided with three permanent fluid barriers. The permanent fluid barriers are formed by a permanent primary cement plug 114, a permanent secondary plug 116 and a permanent surface plug 115. In stead of permanent cement plugs, also different types of permanent seals, such as permanent packer seals, may be used.

Said permanent packer seals may also be used in combination with permanent cement plugs. Alternatively, a permanent fluid barrier is constructed from a packer seal with a permanent cement plug poured on top of the packer seal. It is also possible that the abandoned well 1 comprises two or four permanent fluid barriers.

The required tests for declaring a well 1 abandoned are performed on the permanent fluid barriers. The tests required are defined by the regulations provided by the government on which territory the production platform is located. As always, said regulations can differ for each country. After the well 1 is abandoned, it is in practice not an option to re-enter the well 1. Furthermore, the riser 31 is disconnected from the well 1. After that, the riser 31 is removed from the well 1.

Further embodiments of the method, well abandonment module and use according to the invention are defined by the following clauses.

1. Method for removing a hydrocarbon production platform at sea, said production platform being connected to a hydrocarbon well, and comprising a support structure and an upper part being supported by said support structure, wherein the method comprises the steps of;

A. temporarily closing the well,

B. removing at least part of the upper part from the support structure,

C. positioning a well abandonment module on the support structure, which well abandonment module is constructed and arranged to perform well abandonment operations, D. performing abandonment operations from the well abandonment module to abandon the well, E. removing the well abandonment module from the support structure after the well abandonment operations are completed.

2. Method according to clause 1, wherein the production platform comprises a fluid connection comprising a riser and a wellbore.
3. Method according to clause 1 or 2, wherein step D comprises disconnecting the riser from the well.
4. Method according to any of the preceding clauses, wherein step D comprises performing abandonment tests required to declare the well as being abandoned.
5. Method according to any of the preceding clauses, wherein the production platform comprises a well head and in step A the valves on the well head are closed.
6. Method according to any of the preceding clauses, wherein step A comprises providing a temporary closure in the fluid connection.
7. Method according to any of the preceding clauses, wherein step A comprises providing a temporary closure in the fluid connection at a location above the well.
8. Method according to clause 6 or 7, wherein the temporary closure is located in the riser.
9. Method according to clause 6, wherein the temporary closure is located in the well bore.
10. Method according to any of the preceding clauses, wherein step D comprises providing at least two permanent fluid barriers in the borehole of the well.
11. Method according to clause 10 in combination with clause 4, wherein the abandonment tests comprise testing the permanent fluid barriers.
12. Method according to any of the preceding clauses, wherein the abandonment operations are performed without the assistance of an assisting vessel positioned near the platform.
13. Method according to any of the preceding clauses, wherein the time required for step A is at least 3 times smaller than the time required for step D.
14. Method according to any of the preceding clauses, wherein the method comprises placing the well abandonment module on the support structure at a location where the removed at least part of the upper part was located.
15. Method according to any of the preceding clauses, wherein the method comprises performing the steps A-E in subsequent order.
16. Method according to any of the preceding clauses, wherein the method comprises providing the well abandonment module comprising well abandonment equipment.
17. Method according to any of the preceding clauses, wherein the method comprises providing the well abandonment module comprising equipment which is required for well abandonment operations and not for hydrocarbon production.
18. Method according to any of the preceding clauses, wherein the method comprises providing the well abandonment module comprising drilling equipment.
19. Method according to any of the preceding clauses, wherein the method comprises providing the well abandonment module comprising living accommodations.
20. Method according to any of the preceding clauses, wherein the method comprises providing the well abandonment module comprising a landing platform for a helicopter.
21. Method according to any of the preceding clauses, wherein the steps B and C are performed by a first lifting vessel located near the production platform.
22. Method according to any of the preceding clauses, wherein step C comprises transporting the well abandonment module to the production platform.
23. Method according to any of the preceding clauses, wherein step C comprises lifting the well abandonment module on the support structure with the first lifting vessel.
24. Method according to any of the preceding clauses, wherein step B comprises lifting the removed at least part of the upper part from the production platform with the first lifting vessel.
25. Method according to any of the preceding clauses, wherein step B comprises transporting the removed at least part of the upper part away from the production platform.
26. Method according to any of the preceding clauses, wherein step E is performed from a second lifting vessel located near the production platform.
27. Method according to any of the preceding clauses, wherein step E comprises lifting the removed well abandonment module from the support structure with the second lifting vessel.
28. Method according to any of the preceding clauses, wherein step E comprises transporting the removed well abandonment module away from the abandoned well
29. Method according to any of the preceding clauses, wherein step B comprises partly removing the upper part from the support structure and step E comprises removing the remaining part of the upper part from the support structure.
30. Method according to clause 29, wherein step E comprises transporting the remaining part of the upper part away from the abandoned well.
31. Method according to any of the clauses 1-28, wherein step B comprises completely removing the upper part from the support structure.
32. Method according to any of the preceding clauses, wherein step E comprises removing the support structure.

33. Method according to clause 32, wherein step E comprises transporting the removed support structure away from the abandoned well.
34. Method according to any of the preceding clauses, wherein the method comprises performing removal preparation operations on the production platform before step B.
35. Method according to clause 34, wherein the removal preparation operations comprise cleaning of oil and/or gas pipes located on the production platform.
36. Method according to any of the preceding clauses, wherein step B comprises disconnecting the at least part of the upper part from the support structure.
37. Method according to any of the 1-28 and 32-36 in combination with clause 29 or 30, wherein step E comprises disconnecting the remaining part of the upper part from the support structure.
38. Method according to any of the preceding clauses, wherein the first lifting vessel is equal to the second lifting vessel.
39. Method according to any of the preceding clauses, wherein the steps B, C and E are performed by the same vessel.
40. Method according to any of the preceding clauses, wherein the steps B and C are performed by a first vessel and step E is performed by a different second vessel.
41. Method according to any of the preceding clauses, wherein the method comprises transporting the well abandonment module removed from the support structure to a further production platform to perform the steps A-E on the further production platform.
42. Method according to clause 41, wherein the method comprises after step E adapting the well abandonment module such that the well abandonment module can be positioned on the further support structure.
43. Method according to any of the preceding clauses, wherein the well abandonment module comprises a hoisting device constructed and arranged for hoisting operations to and from the well, which hoisting device is a gantry crane which is moveable along a trajectory, and wherein step C comprises positioning the well abandonment module on the support structure such that the gantry crane is moveable into a position above the well.
44. Method according to any of the preceding clauses, wherein the well abandonment module comprises a pipe reel comprising a length of pipe and step D comprises moving an abandon tool from the well abandonment module to the well, or vice versa, via the pipe.
45. Method according to clause 44, wherein the length of the pipe is at least 1000 m and step D comprises moving the abandon tool with the pipe along a distance of at least 500 m.
46. Method according to clause 44 and 45, wherein the pipe comprises an outer diameter of at least 0.15 m and step D comprises moving the abandon tool with the pipe.
47. Method according to any of the preceding clauses, wherein the well abandonment module comprises an operation opening and the step C comprises positioning the well abandonment module on the support structure such the operation opening is located above the well.
48. Method according to any of the preceding clauses, wherein the production platform is connected to multiple wells, the well abandonment module is constructed and arranged to work on at least two wells at the same time and step D comprises performing well abandonment operations from the well abandonment module on at least two of the wells at the same time to abandon said wells.
49. Well abandonment module constructed and arranged for use in the method according to any of the preceding clauses.
50. Well abandonment module constructed and arranged to assist in hydrocarbon well abandonment operations and comprising a module frame constructed and arranged to in use be positioned on a support structure of a hydrocarbon production platform which is connected to a hydrocarbon well.
51. Well abandonment module according to clause 50, wherein the well abandonment module comprises well abandonment equipment.
52. Well abandonment module according to clause 50 or 51, wherein the well abandonment module comprises equipment which is required for well abandonment operations and not for hydrocarbon production.
53. Well abandonment module according to any of the clauses 50-52, wherein the well abandonment module comprises drilling equipment.
54. Well abandonment module according to any of the clauses 50-53, wherein the well abandonment module comprises living accommodations.
55. Well abandonment module according to any of the clauses 50-54, wherein the well abandonment module comprises a first module frame and a separate second module frame.
56. Well abandonment module according to clause 55, wherein the first module frame comprises well abandonment equipment and the second module frame comprises living accommodations.
57. Well abandonment module according to clause 55 or 56, wherein the first module frame comprises drilling equipment.
58. Well abandonment module according to any of the clauses 50-57, wherein the well abandonment module comprises a landing platform for a helicopter.
59. Well abandonment module according to any of the clauses 55-58, where the second module frame comprises the landing platform.
60. Well abandonment module according to any of the clauses 50-59, wherein the well abandonment module is constructed and arranged to be removed from the support frame and be positioned on a further support frame of a further production platform.
61. Well abandonment module according to any of the clauses 50-60, wherein the well abandonment module comprises a hoisting device constructed and arranged for hoisting operations to and from the well.
62. Well abandonment module according to clause 61, wherein the hoisting device is a gantry crane which is moveable along a trajectory.
63. Well abandonment module according to clause 62, wherein the well abandonment module is constructed and arranged such that gantry crane in use is moveable in a position above the well.
64. Well abandonment module according to any of the clauses 50-63, wherein the well abandonment module comprises a pipe reel comprising a length of pipe.
65. Well abandonment module according to clause 64, wherein the length of the pipe is at least 1000 m.
66. Well abandonment module according to clause 64 or 65, wherein the pipe has an outer diameter of at least 0.15 m.
67. Well abandonment module according to any of the clauses 50-66, wherein the well abandonment module comprises an operation opening.
68. Well abandonment module according to any of the clauses 61-66 and in combination with clause 67, wherein the hoisting device extends above the operation opening.

69. Well abandonment module to clauses 67 or 68, wherein the well abandonment module comprises a work floor extending above the operation opening.

70. Well abandonment module to any of the clauses 50-69, wherein the well abandonment module is constructed and arranged to work on at least two wells at the same time.

71. Use of a well abandonment module according to any of the clauses 49-70.

It will be apparent to those skilled in the art that various modifications can be made to the invention without departing from the scope of the invention.

The invention claimed is:

1. A method for removing a hydrocarbon production platform at sea, said production platform being connected to a hydrocarbon well by a riser forming a fluid connection between the production platform and a hydrocarbon reservoir, and comprising a support structure and an upper part being supported by said support structure, wherein the support structure comprises an upper end and the complete upper part is located on top of said upper end at a distance above sea level, wherein the support structure comprises a lower end supported by the sea bed via a foundation structure and wherein the method comprises the subsequent steps of;

A. temporarily closing the well;

B. removing at least part of the upper part from the support structure;

C. positioning a well abandonment module on top of the upper end of the support structure at a location above sea level where the removed at least part of the upper part was located, which well abandonment module is constructed and arranged to perform well abandonment operations;

D. performing abandonment operations from the well abandonment module to abandon the well; and E. removing the well abandonment module from the support structure after the well abandonment operations are completed.

2. The method according to claim 1, wherein the production platform comprises a fluid connection comprising a riser and a wellbore.

3. The method according to claim 1, wherein step D comprises disconnecting the riser from the well.

4. The method according to claim 1, wherein the production platform comprises a well head and in step A the valves on the well head are closed.

5. The method according to claim 1, wherein step A comprises providing a temporary closure in the fluid connection.

6. The method according to claim 1, wherein step D comprises providing at least two permanent fluid barriers in the borehole of the well.

7. The method according to claim 1, wherein the abandonment operations are performed without the assistance of an assisting vessel positioned near the platform.

8. The method according to claim 1, wherein the well abandonment module comprises a hoisting device constructed and arranged for hoisting operations to and from the well, which hoisting device is a gantry crane which is moveable along a trajectory, and wherein step C comprises positioning the well abandonment module on the support structure such that the gantry crane is moveable into a position above the well.

9. The method according to claim 1, wherein the well abandonment module comprises a pipe reel comprising a length of pipe and step D comprises moving an abandon tool from the well abandonment module to the well, or vice versa, via the pipe.

* * * * *